United States Patent [19]

Hogg, Jr. et al.

[11] 4,416,014

[45] Nov. 15, 1983

[54] COMPOSITE ELECTRODE FOR ARC FURNACE

[75] Inventors: Grady R. Hogg, Jr., Elizabethton; Nathan S. Tanner, Johnson City, both of Tenn.

[73] Assignee: Great Lakes Carbon Corporation, New York, N.Y.

[21] Appl. No.: 404,829

[22] Filed: Aug. 3, 1982

[51] Int. Cl.[3] ..... H05B 7/08

[52] U.S. Cl. ..... 373/93; 373/96

[58] Field of Search ..... 373/88, 90, 91, 92, 373/93, 96

[56] References Cited

U.S. PATENT DOCUMENTS

| | | | |
|---|---|---|---|
| 3,368,019 | 2/1968 | De Corso et al. | 373/90 |
| 3,385,987 | 5/1968 | Wolf et al. | 373/90 X |
| 3,476,861 | 11/1969 | Wolf | 373/90 |
| 4,291,190 | 9/1981 | Elsner et al. | 373/93 UX |

*Primary Examiner*—Roy N. Envall, Jr.

*Attorney, Agent, or Firm*—R. Laddie Taylor

[57] ABSTRACT

A composite electrode for an electric arc smelting furnace has a metal liquid cooled upper clamped section, a consumable graphite lower section and a metal liquid cooled connecting pin. The upper section is fitted with rectangle-shaped tiles of graphite (33) over the area of the electrode held in the electrode power clamp during furnace operation.

3 Claims, 4 Drawing Figures

COMPOSITE ELECTRODE FOR ARC FURNACE

DESCRIPTION

BACKGROUND OF THE INVENTION

1. Field of the Invention

The invention relates generally to an electrode for arc furnaces, and particularly to a composite electrode comprising a liquid-cooled non-consumable upper portion and a consumable tip portion joined to the upper portion by liquid-cooled connection means.

2. Description of the Prior Art

The conventional material employed for the fabrication of electrodes for arc furnaces is graphite. These electrodes are consumed in use due to erosion and corrosion caused by oxidation, vaporization, spalling and other factors. This consumption involves tip losses, column breakage losses and particularly side oxidation losses. An average electric furnace consumes four to eight kilograms of graphite per ton of steel produced.

One method for reducing the consumption of graphite electrodes in arc furnaces has been the application of a protective coating or cladding material to the electrodes with oxidation resistant materials. These coatings generally increase the contact resistance to the electrode clamp, and some are corrosive, as they are based on phosphoric acid. Consequently, they have not found wide acceptance.

Another means for reducing graphite electrode consumption involves the utilization of fully non-consumable electrode systems. The systems employ full length fluid-cooled electrodes with selected apparatus to protect the electrode tip from the extreme temperatures of the arc. Although such systems appear in patent literature, this design has not been commercially successful.

It has been suggested heretofore that composite electrodes comprising carbon or graphite portions attached to a water-cooled metallic piece would provide means for reducing electrode consumption in arc furnaces. A number of patents have issued on specific composite electrode designs. For example, U.S. Pat. Nos. 2,471,531 to McIntyre et al.; 3,392,227 to Ostberg; 4,121,042 and 4,168,392 to Prenn; 4,189,617 and 4,256,918 to Schwabe et al.; and 4,287,381 to Montgomery relate to liquid cooled composite electrodes for arc furnaces. Likewise, European patent applications by C. Conradty Nurnberg designated Nos. 50,683; and 53,200 are directed to composite electrode configurations.

OBJECTS OF THE INVENTION

It is an objective of the invention to provide an improved composite electrode for arc furnaces.

It is a further objective of the invention to provide a composite electrode wherein consumption of the graphite portion is substantially reduced.

It is a still further objective of the invention to provide a composite electrode which is able to resist the harsh environment of an arc furnace and thereby have a long useful life.

SUMMARY OF THE INVENTION

The invention is essentially comprised of a metal tubing main structure with a hollow metal female socket attached at its lower end, cooling liquid inlet and outlet ports or pipes at its top end, a central cooling liquid supply reservoir cylinder occupying the majority of the internal volume of the main tube terminated at its lower end by a header end plate having a central port fitted with tubing leading to the interior of a hollow nipple threaded into the female socket. Cooling liquid enters the electrode through an inlet tube in the upper end plate, passing into the central reservoir, which acts as a water supply and heat sink, out of the tubing at the lower end into the hollow metal nipple. The coolant then passes back out of the nipple into the space between the upper face of the socket and the lower face of the header (which forms the lower end of the internal cylinder), into the annulus between the central internal cylinder and the main structure and out of the electrode through outlet ports in the upper end plate. The preferred coolant is water, suitably treated to avoid scale deposition and corrosion by commercially available chemical and electrical treatment, not forming part of this invention.

The main structure is protected against heat by two types of refractory coverings, a cylindrical covering formed from a plurality of rectangle-shaped tiles of graphite, and graphite rings. The cylindrical covering formed from the rectangle-shaped titles of graphite protect the electrical contact area comprising the upper portion of the main structure held in power-clamping means during the electrode's operation in an electric furnace. The tiles have grooves in the edges thereof parallel to the vertical axis of the main structure, and are held in place by vertical T-shaped ribs attached to the structure.

The lower portion of the electrode is protected from radiant heat and electrical arc shorting by a series of graphite rings encircling the electrode. These are held in place by a metal retaining ring located at the lower end of the female nipple socket fitting a notch in the lower inside diameter of the graphite rings. Each of these is loosely fitted, thus if the bottom one of these rings is damaged, the next one above will slip down on the ring to replace it.

BRIEF DESCRIPTION OF THE DRAWINGS

The invention will become more apparent when described in conjunction with the drawings, in which like reference numerals designate like parts in the several views, and wherein.

DETAILED DESCRIPTION OF THE INVENTION

Figure 1:
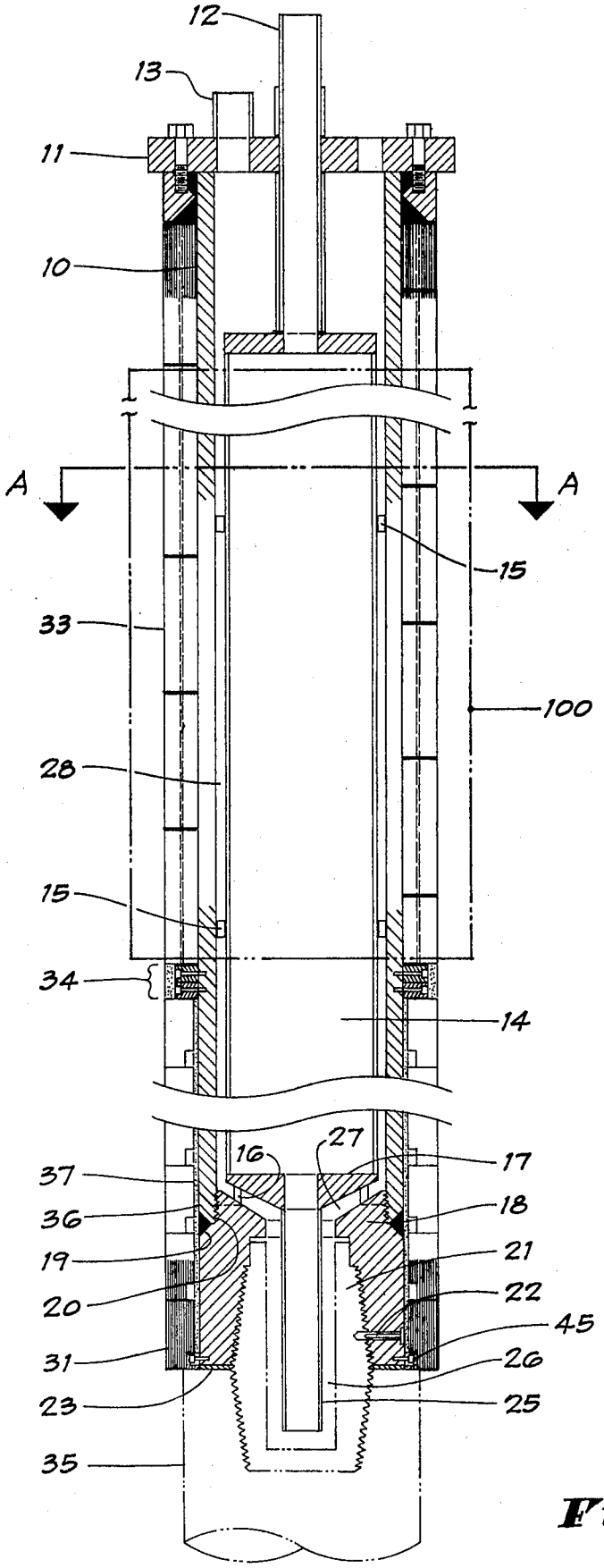
FIG. 1 is a perspective view of the composite electrode of this invention.

Referring now to the drawn Figures, the invention has as its main structure a cylindrical body 10 formed from a single piece of heavy-walled metal tubing. This tubing must have sufficient mechanical strength to support the graphite lower section 35 and must be able to withstand the mechanical stresses in the arc furnace where falling scrap, rough handling and mishandling are normal hazards, and must also transmit the arc current to the graphite electrode without excessive losses due to resistance heating. Aluminum alloy may be used due to its favorable combination of conductivity and strength-weight ratio. It is also possible to use steel tubing, which introduces a severe penalty in resistance heating, or copper, which has an unfavorable strength-weight ratio. Another possible choice would be a copper-clad steel tube, possibly one made with an explosively bonded combination. Aluminum is the preferred material of construction. Other more exotic metals, e.g., titanium, might perform well but would be too expensive for this application.

The upper end of the cylindrical main structure 10 has a head plate 11 featuring a coolant liquid inlet 12 and one or more outlets 13. The head plate 11 is welded to the main structure 10 and sealed with O-rings, as are all of the joints in the structure. In this instance the coolant liquid inlet 12 is a piece of tubing passing through the center of the head plate 11 continuing downwardly a relatively small distance until it joins a central metal internal cylinder 14 concentric with the main structure 10 and having a relatively thin wall and occupying the major part of the volume of the main structure 10. This internal cylinder 14 serves as part of the coolant supply and reservoir for coolant, as well as a heat sink for absorbed conductive and radiant heat. The internal cylinder 14 is held firmly in place by spacers 15 between it and the main structure wall, and at its lower end by spacers 16 between the lower end plate 17 and the female nipple socket 18.

The lower end of the main structure 10 has the female nipple socket 18 of cast aluminum or the like with the same external diameter as the main structure 10 solidly mounted thereto by a weld 19 and by a threaded section 20 engaging the correspondingly threaded lower end of the inner wall of the main structure 10. For good heat transfer, the nipple 21 may be a hollow copper casting. The nipple 21 has a bi-frustro-conical shape; however, a straight sided nipple could be used since nipple breaks should not be a problem, as it is with graphite nipples. This nipple is permanent, or semi-permanent in comparison to graphite. The nipple may be pinned into place in the socket, as by radial dowel pin 22.

The face of the nipple socket 23 may have a plate of copper explosively bonded in place to facilitate electrical conductivity across the interface, although most of the current will pass through the copper nipple to the graphite electrode.

The lower end of the internal cylinder 14 is terminated by a thick heavy plate 17 having a cooling outlet tube 25 which terminates inside the hollow nipple 21, with either an open end or with side openings to increase the flow velocity at the interior side walls.

The coolant liquid enters the electrode through the top inlet 12, passes through the internal cylinder 14 and into the nipple 21, and back up out of the nipple 21 into a first annulus 26 between the outlet tubing 25 and the bore in nipple 21, then into a second annulus 27 between the top of the nipple socket 18 and the lower plate 17 of the internal cylinder 14, then through a third annulus 28 between the main structure 10 and the internal cylinder 14 and back out the outlet or outlets 13 in the upper head plate 11.

The portion of the main structure 10 held by the power clamp, carrying the arc current and holding the electrode in place during operation, is protected by a cylindrical covering formed from a plurality of rectangular shaped tiles of grahite 33 of a thickness effective to conduct the electrode current machined to fit the curvature of the main structure 10. Each tile 33 preferably covers about 60° of the structure's circumference, and is held in place by grooves 29 in each side thereof parallel to the vertical axis of the main structure 10 and fitted into complementary T-shaped vertical ribs 30 attached to the main structure 10.

The lower unclamped area of the electrode is covered with a series of refractory rings 31, which protect the socket area from radiation, slag, arc shorting, and mechanical damage which occur in the arc furnace. These rings 31 are loose-fitting, having an inside diameter slightly larger than the outside diameter of the main structure 10, have the same outside diameter as clamping section segments 34, and are held in place by a metal retaining ring 45 at the lower end of the socket 18, which fits a notch in the lower inner diameter of the rings 31. If the bottom ring, which is most likely to be damaged, falls off, the rings above it will slip down to protect the area of most danger. If an arc occurs between a piece of scrap and the composite electrode, the metal is protected against melting by the rings 31, which diffuse the current and the heat produced.

The annulus between the refractory rings 31 and the main structure 10 is occupied by refractory fiber insulation 36 covered with radiation reflective insulation 37.

Ribs 30 hold the graphite tiles 33 in place against shifting when torque is applied during removal and replacement of the grahite lower electrodes. They also strengthen the main tubing.

While the invention has been described in detail and with reference to a specific embodiment thereof, it will be apparent to one skilled in the art that various changes and modifications can be made therein without departing from the scope and spirit thereof, and, therefore, the invention is not intended to be limited except as indicated in the appended claims.

I claim:

1. In an electrode for an electric arc smelting furnace comprising an upper liquid cooled section, a threaded connecting nipple, and a graphite lower section, the improvement comprising the provision of a cylindrical covering formed from a plurality of rectangle-shaped tiles of graphite protecting that portion of the exterior of said upper section held in power clamping means during operation of said furnace, said tiles having grooves therein in the edges thereof parallel to the vertical axis of said upper section and being held in place by vertical T-shaped ribs attached to said upper section and complementary to said grooves.

2. An electrode for an electric arc smelting furnace comprising an upper liquid cooled section, a hollow threaded connecting nipple, and a graphite lower section, (a) said upper section comprising:

1. a cylindrical main structure formed from metal tubing;
2. its upper end comprising a head plate having a cooling liquid inlet and cooling liquid outlets;
3. said inlet comprising tubing connected to an exterior liquid supply, passing through said head plate, connected to the top plate of a metal internal cylinder concentric with said main structure and occupying a majority of the internal volume of said main structure;
4. said internal cylinder serving as a liquid reservoir, heat sink, and passageway for cooling liquid;
5. said internal cylinder having a bottom plate connected with liquid outlet tubing extending to the interior cavity of said nipple;

6. said liquid inlet, internal cylinder, and outlet tubing forming liquid inflow means for cooling said nipple;
7. said nipple being threaded in place in a metal female socket comprising the lower end of said main structure;
8. a first annulus between said outlet tubing and said nipple communicating with a second annulus between the upper end of said socket and the bottom face of said bottom plate defined by spacers;
9. said second annulus communicating with a third annulus defined by the inside wall of said main structure and the outside wall of said internal cylinder;
10. said third annulus connected with cooling liquid outlets on said upper main top plate;
11. said annuli forming cooling liquid outflow means;
12. the exterior of the electrical contact area comprising the upper portion of said main structure having a cylindrical covering formed from a plurality of rectangle-shaped tiles of graphite of a thickness effective to conduct the electrode current;
13. said tiles having grooves in the edges thereof parallel to the vertical axis of said main structure;
14. said tiles being held in place by vertical T-shaped ribs attached to said main structure having a complementary configuration to said grooves in said tiles;
15. the lower portion of said main structure being insulated with a series of refractory rings having an inside diameter slightly larger than the outside diameter of said main structure, notched at the lower inside radius to match the dimension of a metal retaining ring;
16. the annulus between said refractory rings and said main structure occupied by refractory fiber insulation covered with radiation reflective insulation;

(b) said nipple being hollow, metal, and threaded, defining a cavity having its upper end open and lower end closed;

(c) said lower section being a column comprising one or more graphite electrode sections.

3. The electrodes of claims 1 or 2 wherein the upper liquid cooled main section comprising the main tubing, upper end plate, internal cylinder and nipple socket are constructed of aluminum.

* * * * *

UNITED STATES PATENT AND TRADEMARK OFFICE

CERTIFICATE OF CORRECTION

PATENT NO. : 4,416,014

DATED : November 15, 1983

INVENTOR(S) : Grady R. Hogg, Jr., et al.

Figure 2:
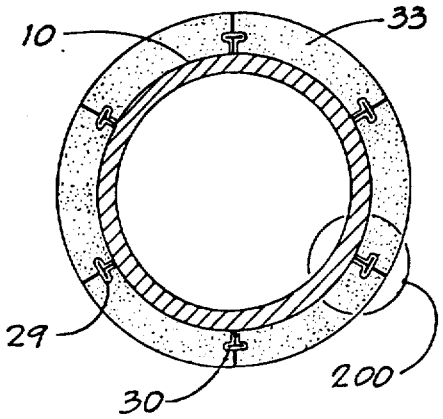
FIG. 2 is a sectional top view taken along lines A-A. The apparatus at the bottom of the main cylinder has been omitted for clarity.
Figure 3:
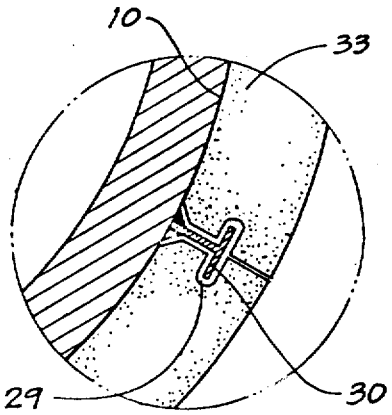
FIG. 3 is an enlarged view of Section 200 of FIG. 2.
Figure 4:
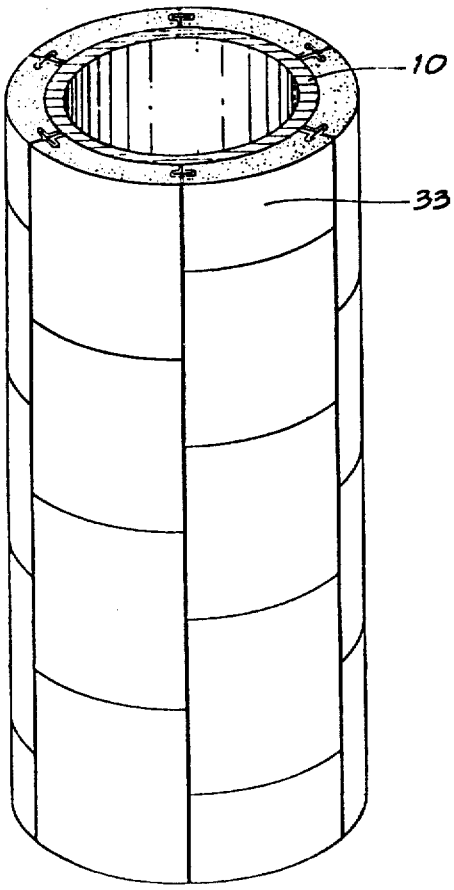
FIG. 4 is an isometric view of the outside of the main cylinder 10 defined as it would appear at Section 100 of FIG. 1.

It is certified that error appears in the above-identified patent and that said Letters Patent is hereby corrected as shown below:

The sheet of drawings consisting of Figs. 2, 3 and 4 should be added as per attached sheet.

Signed and Sealed this

*Twenty-second* Day of *May 1984*

[SEAL]

*Attest:*

GERALD J. MOSSINGHOFF

*Attesting Officer*

*Commissioner of Patents and Trademarks*

Patent No. 4,416,014 - November 15, 1983

Grady R. Hogg, Jr., et al.